United States Patent [19]

Barnes et al.

[11] Patent Number: 4,624,632

[45] Date of Patent: Nov. 25, 1986

[54] FLAME FAILURE DEVICE

[75] Inventors: Hugh V. Barnes, Sutton Coldfiel; William M. Russell, Arundel, both of England

[73] Assignee: T. I. Domestic Appliances Limited, London, England

[21] Appl. No.: 814,522

[22] Filed: Dec. 19, 1985

Related U.S. Application Data

[63] Continuation of Ser. No. 628,561, Jul. 3, 1984, abandoned.

[30] Foreign Application Priority Data

Jul. 6, 1983 [GB] United Kingdom ..... 8318323
May 1, 1984 [GB] United Kingdom ..... 8411064

[51] Int. Cl.[4] ..... F23N 5/00

[52] U.S. Cl. ..... 431/77; 431/58; 137/828

[58] Field of Search ..... 431/58, 75, 77; 137/828

[56] References Cited

U.S. PATENT DOCUMENTS 3,895,901 7/1975 Schwartz ..... 431/77
4,303,384 12/1981 Barnes ..... 431/58

*Primary Examiner*—Carroll B. Dority, Jr.
*Attorney, Agent, or Firm*—Mason, Fenwick & Lawrence

[57] ABSTRACT

A flame failure device for a gas-fired appliance has a heat sensitive device (24') in the form of fine bore tube (25). The tube is connected to one chamber (10) of a pressure sensitive gas flow control valve assembly. The chamber is pressurized and the rate of flow from the chamber is controlled by flow through the fine bore tube (25) the application of heat to which reduces the rate of flow through the fine bore tube (25) while the withdrawal of heat restores the rate of flow. Heat is provided by a gas burner of the appliance. The fine bore tube may have a non-circular cross-section and be formed by deforming part at least of a length of tubing (FIGS. 4A and 5A).

7 Claims, 7 Drawing Figures

FLAME FAILURE DEVICE

This application is a continuation of application Ser. No. 628,561, filed July 3, 1984, abandoned.

BACKGROUND OF THE INVENTION

Field of the invention

This invention relates to flame failure devices and has particular although not exclusive reference to flame failure devices for use in safety systems for gas-fired appliances.

It is an object of the present invention to provide an improved flame failure device that is of simplified form as compared with known devices.

SUMMARY OF THE INVENTION

According to the present invention, a flame failure device comprises a heat sensitive member in the form of a fine bore tube, and a fuel flow control valve assembly including a fuel flow control valve operable by means responsive to the fluid pressure in a pressurisable chamber which the fine bore vents to atmosphere, the arrangement being such that the application heat to a part at least of the fine bore tube causes the latter to reduce the venting of the chamber to atmohere and the withdrawal of heat from the tube to restore the venting to its pre-reduction value.

Alternatively, a flame failure device according to the invention and suitable for a gaseous fuel burner may comprise a heat sensitive member in the form of a fine bore tube open to atmosphere at one end and connected at the other end to a pressurisable chamber, a gaseous fuel flow control valve assembly having a gaseous fuel inlet and outlet, means responsive to the gaseous pressure in the chamber, flow control means controlled by the pressure responsive means for controlling the flow of gaseous fuel from the inlet to the outlet, and in which the arrangement is such that heat applied to a part at least of the fine bore tubing results in an increase of pressure in the chamber and the withdrawal of that heat allows the pressure in the chamber to return to its original value.

The pressurisable chamber may be pressurised via a restricted connection between the inlet and the chamber.

The pressure responsive member may comprise a flexible diaphragam.

In one embodiment of the invention, the fine bore tube is a tube of circular cross-section, but, in other embodiments, the fine bore tube has a non-circular cross section. In these other embodiments, the fine bore tube may be formed by deforming part at least of a length of tubing to reduce the cross-sectional area of the bore of the tubing to that of a fine bore tube.

The fine bore tube may be connected to one end of a length of tubing of larger cross-section, the other end of which tubing is connected to the pressurisable chamber. Alternatively, the fine bore tube may be part of a length of tubing, the remainder of the tubing having a bore of larger cross-sectional area. In this case, the fine bore tube may be formed by deforming part of the length of tubing to reduce the cross-sectional area of the bore of the tubing to that of a fine bore tube.

DESCRIPTION OF THE DRAWINGS

By way of example only, embodiments of the invention suitable for use in a gas-fired appliance will now be described in greater detail with reference to the accompanying drawings of which.

DETAILED DESCRIPTION OF THE PREFERRED EMBODIMENTS OF THE INVENTION

Figure 1:
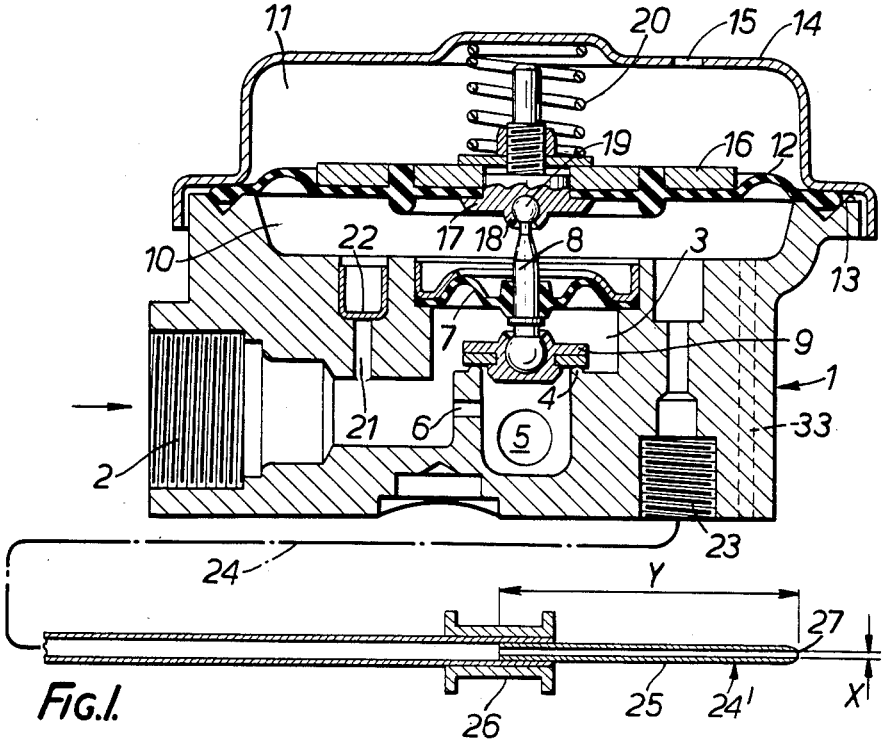
FIG. 1 is a section partly in block schematic form of an embodiment.

The embodiment of FIG. 1 comprises a main gas flow control valve assembly 1 including a housing with a gas inlet 2 in communication with an internal chamber 3 contoured to provide a valve seating 4 and with a gas outlet 5. A by-pass passage 6 interconnects the inlet 2 with the outlet 5.

The upper face of the housing as seen in FIG. 1 is formed to accommodate a diaphragm seal 7 that seals off the upper part of the chamber 3 and supports a stem 8 carrying, within chamber 3, a gas valve 9 that cooperates with seating 4 to control the main flow of gas from inlet 2 to outlet 5.

The upper face of the housing is recessed to form a lower chamber 10 separated from an upper chamber 11 by a flexible diaphragm 12 secured at its periphery between a clamping surface 13 formed round the chamber 10 and removable top cover 14. Upper chamber 11 is vented to atmosphere via a vent hole 15.

Diaphragm 12 carries a central diaphragm plate 16 which supports a mounting 17 with a socket 18 for a ball 19 formed at the upper end of stem 8, the socket 18 and ball 19 forming a universal joint.

Stressed between plate 16 and the top cover 14 is a helical spring 20 that loads the diaphragm 12 and thus valve 9 urging the latter into contact with the valve seating 4 as shown in FIG. 1.

A passage 21 containing a restrictor 22 interconnects inlet 2 and lower chamber 10, the restrictor 22 being such that it permits, in use, a very small flow of gas from the inlet to chamber 10.

An outlet 23 from chamber 10 is connected by a length of tubing indicated by dotted line 24 to a flame sensing device 24' that consists of a length of fine bore tube 25 joined at one end to tubing 24 by a connector 26 and open at its other end as indicated at 27.

The length Y of the tube 25 and its internal diameter X are chosen so that the application of heat to the tube or to a portion thereof heats the gas within the tube to an extent sufficient to decrease the specific gravity of the gas in the tube 25 and to increase the kinematic viscosity thereof thereby reducing the rate of flow of gas through the tube 25. Typical values for X and Y are about 0.56 mm and 30 mm respectively.

The assembly shown in FIG. 1 can be used to control the flow of gas to a burner that is connected to outlet 5. The tube 25 is located adjacent the main burner so that, when ignited, the flames of the latter will provide the necessary heating of the tube 25.

In use, gas entering inlet 2 flows via passage 21 and restrictor 22 into chamber 10 but this does not affect the position of diaphragm 12 because there is a constant, controlled flow of gas from chamber 10 via outlet 23, tubing 24 and tube 25 to atmosphere via open end 27. Thus, spring 20 holds the diaphragm 12 in the position shown in FIG. 1 and valve 9 remains seated on seating 4.

If now tube 25 is heated, the controlled flow of gas from chamber 10 is reduced considerably because of the factors referred to above and the pressure in chamber 10 rises until it overcomes the loading of spring 20 and diaphragm 12 deflects upwardly so lifting valve 9 away from seating 4 and allowing gas to flow at maximum rate from inlet 2 to outlet 5 and thus to the burner.

If, for some reason, the burner is extinguished, tube 25 cools and the rate of flow of gas therethrough to the open end rises. The pressure in chamber 10 drops and spring 20 restores the diaphragm 12 to the position shown in FIG. 1 and valve 9 closes on to seating 4 so reducing the flow of gas to the burner to the low value permitted by the by-pass 6.

Figure 4A:
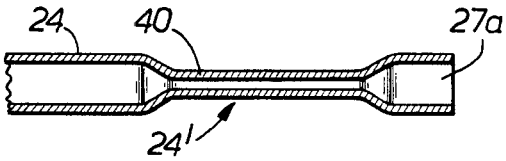
FIGS. 4A and 4B and FIGS. 5A and 5B illustrate modifications of the embodiments of FIGS. 1 to 3.
Figure 4B:
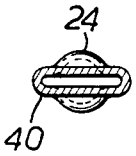

FIGS. 4A and 4B illustrate a modification of the arrangement just described. In this modification, the separate fine bore tube 25 of FIG. 1 is not used and, instead, the flame sensing device 24' is formed in the length of the tubing 24 towards the end remote from the outlet 23 of the chamber 10. As in FIG. 1, the flame sensing device 24' consists of a length of fine bore tubing but is formed by deforming part 40 of the tubing 24 to reduce the cross-sectional area of the bore of the tubing 24 to that of a fine bore tube. The end 27*a* of the tubing 24 is left open to atmosphere.

Figure 5A:
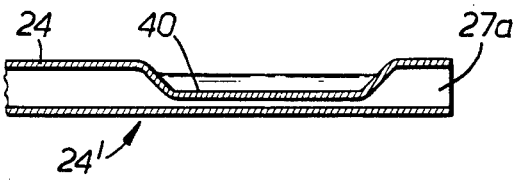
Figure 5B:
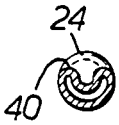

The portion 40 of the tubing is deformed, in this case, by flattening, producing a cross-section as shown in FIG. 4B. However, alternative shapings for this portion 40 of the tubing are possible: for example, the tubing 24 could be deformed by "dunching" or "canoeing" as shown in FIG. 5A producing a concave cross-section as shown in FIG. 5B.

Whatever the shaping employed for the fine bore portion 40, its length and the cross-sectional area of its bore are chosen so that the application of heat to this portion, or part of it, heats the gas within the fine bore portion to an extent sufficient to decrease the specific gravity of the gas and increase its kinematic velocity thereby reducing the rate of flow of gas through the portion 40. Typically, the bore of the portion 40 has the cross-sectional area of a circle of diameter 0.56 mm and the length of the portion 40 may be 15 to 30 mm. .

It will be appreciated that the portion 40 of the tubing 24 will function in the same manner as the separate fine bore tube 25 of FIG. 1. However, the modifications of FIG. 4, A and B and FIG. 5, A and B do enable performance requirements of the associated valve assembly 1 to be met more accurately by controlling the deformation of the tubing 24.

Figure 2:
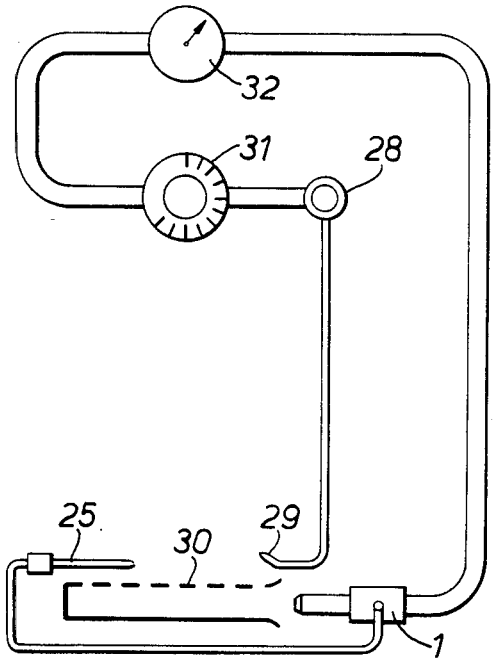
FIGS. 2 and 3 are block schematics of other embodiments of the invention.

FIG. 2 shows the arrangement described with reference to FIG. 1 in a more detailed form suitable for use in a gas cooking appliance, the burner being that of the main oven of the appliance.

A main gas inlet 28 feeds a pilot burner 29 directly and also the oven burner 30 via a combined gas tap/thermostat shown schematically at 31, a clock controlled valve indicated schematically at 32 and the valve assembly 1. Tube 25 is located as shown so as to respond to the heat of the flames of the oven burner 30 when ignited.

In use, a user operates tap/thermostat 31 to a desired temperature setting and control 32 to the time at which a cooking operation is to start. At the set time, gas flows to assembly 1 and via the by-pass 6 to the oven burner 30 when it is ignited by the flame of the pilot burner 29. Tube 25 is now heated by the oven burner 30 and as described above, the controlled flow of gas from chamber 10 drops to a low value, and valve 9 is lifted away from seating 4. Gas can now flow to the oven burner 30 at maximum rate.

Disappearance of the oven burner flame allows tube 25 to cool and the flow of gas to that burner drops to the very low stand-by rate permitted by the by-pass 6.

Figure 3:
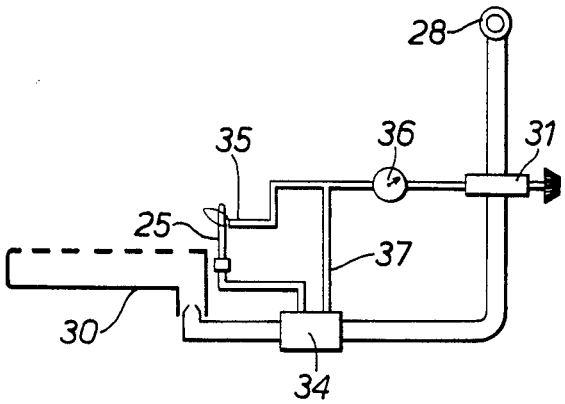

Another example of a gas burner installation embodying the invention and suitable for the main oven burner of a gas cooking appliance is shown diagrammatically in FIG. 3. This embodiment employs a slightly modified form of the assembly 1 used in FIG. 1. In the modifed form, the passage 21 and the restrictor 22 are replaced by a restricted passage 33 shown in dotted lines in FIG. 1. Also by-pass 6 is not present.

In the FIG. 3 embodiment, main gas inlet 28 feeds oven burner 30 via a combined tap/thermostat 31 and the modified assembly 34. An ignition burner 35 is fed directly from tap/thermostat 31 via a clock controlled valve 36. Also connected to the gas supply controlled by valve 36 by a pipe 37 is the passage 33 of the modified assembly. Tube 25 is so located that it is heated by the flame of the ignition burner 35 when ignited. The embodiment also includes an ignition device (not shown) for the ignition burner 35. The ignition device which may be a spark ignition device operates automatically as will be described below when the clock controlled valve opens.

The embodiment of FIG. 3 operates in the following manner: a user first sets the tap/thermostat 31 and clock-controlled valve 36 as described above. At the set time, clock-controlled valve 36 opens and gas flows to the ignition burner 35 where it is ignited by the ignition device that has been actuated on opening of the clock-controlled valve. Gas also passes via pipe 37 and passage 33 to chamber 10 but because of the restricted inlet to chamber 10 via passage 33 and controlled exit of gas from this chamber via passage 23, tubing 24 and tube 25, diaphragm 12 remains in the position shown in FIG. 1 and valve 9 remains closed on seating 4. Gas also passes to inlet 2 of assembly 34 but does not flow to the oven burner 30.

Tube 25 becomes heated by the ignition burner flame and the controlled flow of gas from chamber 10 drops to a very low value. The gas pressure in chamber 10 increases and valve 9 lifts away from seating 4. Gas can now flow to the oven burner 30 where it is ignited by the flame of the ignition burner 35.

Loss of flame at the ignition burner 35 allows tube 25 to cool with the result that valve 9 closes down on to seating 4 and the supply of gas to oven burner 30 is cut-off and remains so until the ignition burner 35 is re-ignited.

It will be appreciated that other forms of gas pressure sensitive means than flexible diaphragm may be used to sense changes in pressure in chamber 10.

It will also be appreciated that the embodiments shown in FIGS. 2 and 3 could incorporate the modification illustrated in FIG. 4, A and B or FIG. 5, A and B.

What is claimed is:

1. A flame failure device comprising a heat sensitive member in the form of a fine bore tube open to atmosphere at one end, and a fuel flow control valve assembly including means forming a pressurizable chamber and including a pressure-operated diaphram fuel flow control valve exposed to the fluid pressure in the pressurizable chamber to be operated thereby, in which the fine bore is connected at the other end to the pressurizable chamber, whereby the tube vents the chamber directly to atmosphere, said fuel flow valve assembly including a fuel passage extending therethrough and said pressure operated valve being located in said passage to control fuel therethrough, means forming a vent passage connecting said fuel passage upstream of said pressure operated valve with said pressurizable chamber, the arrangement being such that the application of heat to a part at least of the fine bore tube causes the latter to reduce the venting of the chamber to atmosphere and the withdrawal of heat from the tube causes the latter to restore the venting to its prereduction value.

2. A flame failure device for a gaseous fuel burner comprising a gaseous fuel flow control valve assembly having: a gaseous fuel passage having an inlet and outlet; diaphragm means forming a pressurizable control chamber in said central valve assembly; means responsive to the gaseous pressure in the control chamber, and flow control means controlled by the diaphragm means for controlling the flow of gaseous fuel from inlet to the outlet, a heat sensitive member in the form of a fine bore tube open to atmosphere at one end and means connecting the fine bore tube at the other end to the pressurizable chamber, to vent the chamber directly to atmosphere, and a vent passage connecting said gaseous fuel passage upstream of said flow control means with said control chamber, in which the arrangement is such that: heat applied to a part at least of the fine bore tube reduces the venting of the control chamber and results in an increase of pressure therein, and the withdrawal of that heat restores the venting and allows the pressure in the chamber to return to its original value.

3. A device as olaimed in claim 2 in which the vent passage has a restriction.

4. A device as claimed in claim 1, in which the fine bore tube has a circular cross-section.

5. A device as claimed in claim 1, in which the fine bore tube has a non-circular cross-section and is formed by deforming part at least of a length of tubing.

6. A device as claimed in claim 1, in which the fine bore tube is connected to the pressurisable chamber by a length of tubing of larger cross-section.

7. A device as claimed in claim 6, in which the fine bore tube has a non-circular cross-section and is formed by deforming part of the length of tubing of larger cross-section.

* * * * *